US012383056B1

(12) United States Patent
Zheng

(10) Patent No.: US 12,383,056 B1
(45) Date of Patent: Aug. 12, 2025

(54) TABLE WITH CONCEALED CABLE MANAGEMENT

(71) Applicant: ODK TECHNOLOGY PTE. LTD., Singapore (SG)

(72) Inventor: Hongbing Zheng, Hangzhou (CN)

(73) Assignee: ODK TECHNOLOGY PTE LTD., Singapore (SG)

( * ) Notice: Subject to any disclaimer, the term of this patent is extended or adjusted under 35 U.S.C. 154(b) by 0 days.

(21) Appl. No.: 18/909,986

(22) Filed: Oct. 9, 2024

(30) Foreign Application Priority Data

Aug. 28, 2024 (CN) ..... 202422099586.3

(51) Int. Cl.
*A47B 21/06* (2006.01)

(52) U.S. Cl.
CPC ..... *A47B 21/06* (2013.01)

(58) Field of Classification Search
CPC ..... A47B 21/06; A47B 2200/008
USPC ..... 108/50.02; 312/223.6
See application file for complete search history.

(56) References Cited

U.S. PATENT DOCUMENTS 4,600,173 A * 7/1986 Frascaroli ..... F16B 7/044 248/228.6
4,748,913 A * 6/1988 Favaretto ..... A47B 17/00 108/50.02
4,762,072 A * 8/1988 Boundy ..... A47B 21/06 108/50.02
4,838,177 A * 6/1989 Vander Park ..... A47B 21/06 108/50.02
5,638,759 A * 6/1997 Klugkist ..... A47B 21/06 108/50.02
5,673,632 A * 10/1997 Sykes ..... A47B 21/06 108/50.02
5,901,513 A * 5/1999 Mollenkopf ..... A47B 21/06 312/196
5,934,201 A * 8/1999 Diffrient ..... A47B 21/06 108/50.02
5,934,203 A * 8/1999 Glass ..... A47B 87/002 108/50.02
6,003,447 A * 12/1999 Cox ..... A47B 21/06 108/50.02
6,327,983 B1 * 12/2001 Cronk ..... A47B 21/06 108/50.02
6,338,301 B1 * 1/2002 Almond ..... A47B 21/06 108/26

(Continued)

*Primary Examiner* — Jose V Chen
(74) *Attorney, Agent, or Firm* — IPRTOP LLC

(57) ABSTRACT

A table with concealed cable management is provided. The table includes a cable management component including a cable management shelf, a support frame, and fixing frames. The cable management shelf is connected to the support frame to provide support for the power supply equipment with the support of the support frame. The support frame is connected to the table via the fixing frames, so that the cable management component is disposed at the bottom of the table. The cable management component is combined with the table's frame structure, integrating the cable management function into the table's design, effectively utilizing the space below and resolving potential safety hazards from messy wiring of existing power supply equipment. Additionally, this design eliminates the need for external cable management equipment, such as a cable manager. This integration enhances both the overall stability and integration of the table.

11 Claims, 6 Drawing Sheets

(56) References Cited

U.S. PATENT DOCUMENTS 6,415,723 B1 * 7/2002 Kopish ..... A47B 21/06 108/50.02
6,448,498 B1 * 9/2002 King ..... A47B 21/06 138/155
6,647,900 B1 * 11/2003 Kopish ..... A47B 3/0815 108/115
6,725,784 B2 * 4/2004 Crinion ..... A47B 87/002 108/50.01
7,343,864 B2 * 3/2008 Canin ..... A47B 47/00 108/50.02
7,871,280 B2 * 1/2011 Henriott ..... A47B 21/06 108/50.02
8,186,281 B2 * 5/2012 Bastian ..... A47B 83/001 108/50.02
11,771,219 B2 * 10/2023 Colin ..... A47B 87/002 108/50.02
2003/0089283 A1 * 5/2003 Okamoto ..... A47B 17/02 108/50.02
2004/0149177 A1 * 8/2004 Gayhart ..... A47B 21/06 108/50.02
2005/0284341 A1 * 12/2005 Klassy ..... A47B 21/00 108/50.02
2006/0065167 A1 * 3/2006 Chi ..... A47B 21/0314 108/50.02
2009/0273260 A1 * 11/2009 Kemp ..... A47B 21/06 108/50.02
2010/0024687 A1 * 2/2010 Preiss ..... A47B 21/06 108/50.02
2010/0024688 A1 * 2/2010 Kitada ..... A47B 21/06 108/154
2015/0351530 A1 * 12/2015 Udagawa ..... F16L 3/26 108/50.02
2018/0110327 A1 * 4/2018 Keller ..... B60R 16/0215
2018/0338608 A1 * 11/2018 Keller ..... A47B 9/12
2019/0069669 A1 * 3/2019 Hall ..... H05K 7/18
2019/0246791 A1 * 8/2019 Lundberg ..... A47B 21/06
2020/0196747 A1 * 6/2020 Lu ..... A47B 9/00
2021/0106133 A1 * 4/2021 Anderson ..... H02G 3/0406
2022/0378194 A1 * 12/2022 Lin ..... A47B 21/06
2023/0270246 A1 * 8/2023 Lin ..... A47B 9/04 108/50.02
2024/0130529 A1 * 4/2024 Choi ..... F16M 11/2092

* cited by examiner

TABLE WITH CONCEALED CABLE MANAGEMENT

FIELD OF THE INVENTION

The present disclosure relates to the technology field of tables, specifically to a table with concealed cable management.

BACKGROUND OF THE INVENTION

In modern home life, gaming desks, square tables, and height-adjustable desks are essential pieces of furniture. As indoor living becomes more diverse and personalized, the variety and quantity of equipment placed on tables have been increasing. This leads to a complex and often messy arrangement of cables on and under the table. On one hand, this affects the overall aesthetic of the desk layout. On the other hand, the disorganized cables are more prone to damage from people or pets, which can render the equipment unusable, pose safety hazards during equipment use or movement, and increase maintenance costs.

SUMMARY OF THE INVENTION

The present disclosure provides a table with concealed cable management. The table includes a cable management component. The cable management component includes a cable management shelf, a support frame, and fixing frames. The cable management shelf is connected to the support frame, so that it can support the power supply equipment with the support of the support frame; the support frame is connected to the table via the fixing frames, so that the cable management component is disposed at the bottom of the table.

In one embodiment, the fixing frames are provided on two sides of table legs of the table, and the support frame is respectively connected to the fixing frames on the two sides of the table, so that the cable management component is disposed at the bottom of the table through the fixing frames.

The fixing frames are disposed below the table, and the support frame is connected to the fixing frames, so that the cable management component is disposed at the bottom of the table through the fixing frames.

In one embodiment, the cable management shelf is disposed on the support frame through a screw.

In one embodiment, the support frame is provided with multiple fixing holes, and the cable management shelf is fixed to different fixing holes of the support frame by screws to realize adjustable positioning.

In one embodiment, the cable management shelf is arranged at any position of the support frame by welding.

In one embodiment, the cable management shelf is arranged on the support frame via a sliding rail, so that the cable management shelf is movable along a long axis of the support frame within the sliding rail of the support frame.

In one embodiment, the cable management shelf includes a bottom surface and at least one side surface. The bottom surface is provided with a first opening to allow the power cables and/or device cables of the power supply equipment to pass through. One side surface is provided with a second opening to allow the power cables and/or device cables of the power supply equipment to pass through.

In one embodiment, the cable management shelf is made of steel, plastic or wood, and the support frame is made of pipes, plastic or wood.

In one embodiment, the cable management component is detachably disposed at the bottom of the table.

In one embodiment, the cable management component is fixedly disposed at the bottom of the table.

As described above, the table with concealed cable management of the present disclosure has the following beneficial effects:

According to the table with concealed cable management of the present disclosure, the cable management component is combined with the frame structure of the table, so that the cable management function is integrated into the structural design of the table, the space below the table is effectively utilized, and the problem of potential safety hazards caused by messy wiring of existing power supply equipment is solved. At the same time, the installation method that combines the cable management component with the frame structure of the table eliminates the need for external cable management equipment, such as a cable manager. This integration makes the table structure more integrated and stable.

In the present disclosure, the cable management component is detachably disposed below the table, and all the components of the table are detachably connected, that is, the overall structure of the table is detachable, thereby reducing the packaging volume and effectively utilizing the space below the table.

In the present disclosure, when the fixing frames of the cable management component are the table side frames, the support frame of the cable management component is respectively connected to the fixing frames on two sides of the table legs, so that the cable management component is disposed below the second table board of the table, ensuring the stability of the table and the bearing capacity of the cable arrangement layer. Meanwhile, the storage capacity can be enhanced by connecting the cable management shelf, the support frame and the table side frames (fixing frames). At the same time, under the support of the support frame, the cable management shelf can easily accommodate external power strips or device cables while remaining concealed under the table, without affecting the overall appearance.

The cable management component of the table with concealed cable management in the present disclosure is easier to install and less expensive compared to external cable management devices currently available in the market.

REFERENCE NUMERALS

Figure 1:
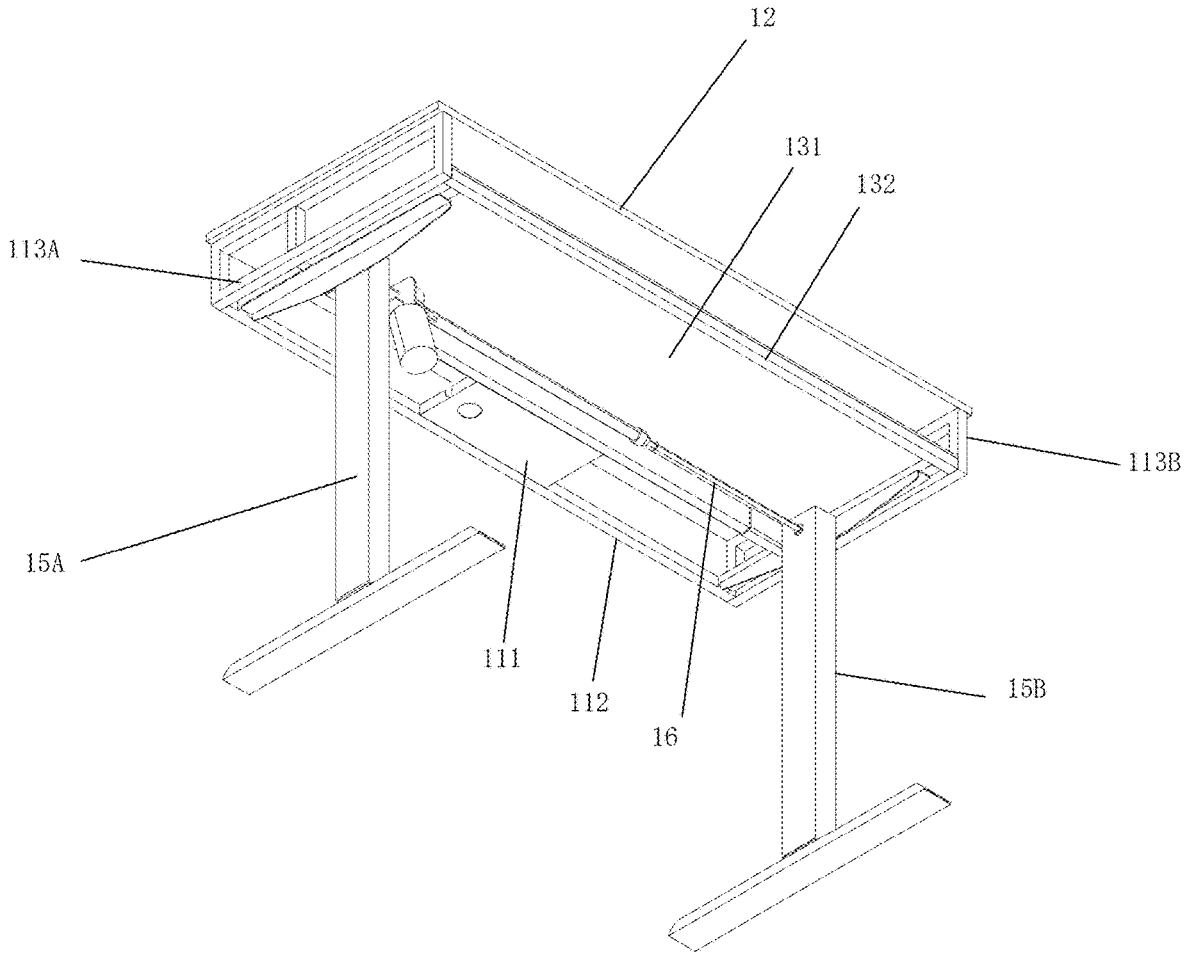
FIG. 1 shows a schematic structural diagram of a table with concealed cable management according to one embodiment of the present disclosure.

1 Table with concealed cable management
11 Cable management component
111 Cable management shelf
1111 Bottom surface
11111 First opening
1112 Side surface
1112A First side surface
1112B Second side surface
11121 Second opening
11121A First side opening
11121B Second side opening
112 Support frame
113 Fixing frame
113A First fixing frame
113B Second fixing frame
12 First table board
13 Second table board
131 Shelf board
132 Shelf connector frame
14 Table side frame
14A First table side frame
14B Second table side frame
15 Table leg
15A First table leg
15B Second table leg
16 Connecting rod

DETAILED DESCRIPTION

The specific embodiments are described below to illustrate the implementation of the present disclosure, and those skilled in the art can easily understand other advantages and effects of the present disclosure from the content disclosed in this specification. The present disclosure can also be implemented or applied in other specific embodiments. The details provided in this description can be modified or altered in various ways based on different perspectives and applications without departing from the spirit of the present disclosure. It should be noted that the embodiments and features of the embodiments in the present disclosure can be combined with each other as long as there is no conflict.

It should be noted that the illustrations provided in the following embodiments are merely schematic representations to explain the basic concepts of this application. Therefore, the figures only show components related to this application and are not drawn according to the actual number, shape, and size of components in practice. The actual implementation may involve variations in the type, quantity, and proportions of the components, and the layout of the components could be more complex.

The following embodiments of the present disclosure provide a table with hidden wire management, which solves the problem of the existing technology where the power supply cables on and under the desk are tangled and disorganized, leading to potential safety hazards.

The following will detail the principles and implementation methods of a hidden cable management table in an embodiment, with reference to the accompanying drawings, so that those skilled in the art can understand the hidden cable management table of this embodiment without requiring inventive effort.

As shown in FIG. 1, a table with concealed cable management is provided. The table includes a cable management component 11. The cable management component 11 includes a cable management shelf 111, a support frame 112, and fixing frames 113.

The cable management shelf 111 is connected to the support frame 112, so that the cable management shelf 111 can support the power supply equipment with the support of the support frame 112.

The support frame 112 is connected to the table 1 via the fixing frames 113, so that the cable management component 11 is disposed at the bottom of the table 1.

According to the table with concealed cable management of the present disclosure, the cable management component 11 is combined with the frame structure of the table 1, so that the cable management function is integrated into the structural design of the table, the space below the table is effectively utilized, and the problem of potential safety hazards caused by messy wiring of existing power supply equipment is solved. At the same time, the installation method that combines the cable management component 11 with the frame structure of the table 1 eliminates the need for external cable management equipment, such as a cable manager. This integration makes the table structure more integrated and stable.

In one embodiment of the present disclosure, the fixing frames 113 are provided on two sides of the table legs, and the support frame 112 is respectively connected to the fixing frames 113 on both sides of the table 1, so that the cable management component 11 is disposed at the bottom of the table 1 through the fixing frames 113.

Figure 2:
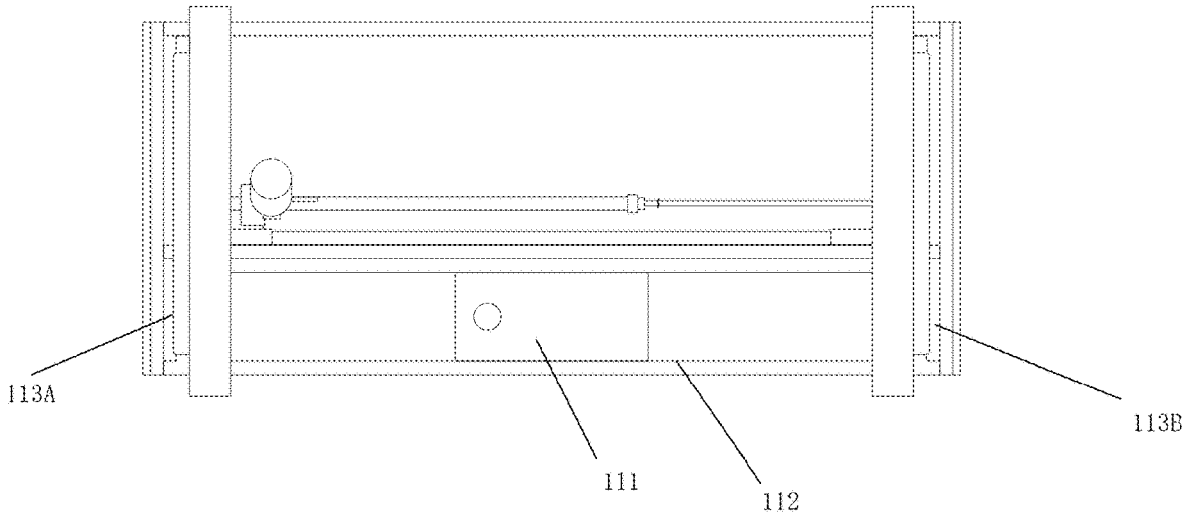
FIG. 2 shows a schematic structural view of a bottom view of a table with concealed cable management according to one embodiment of the present disclosure.
Figure 3:
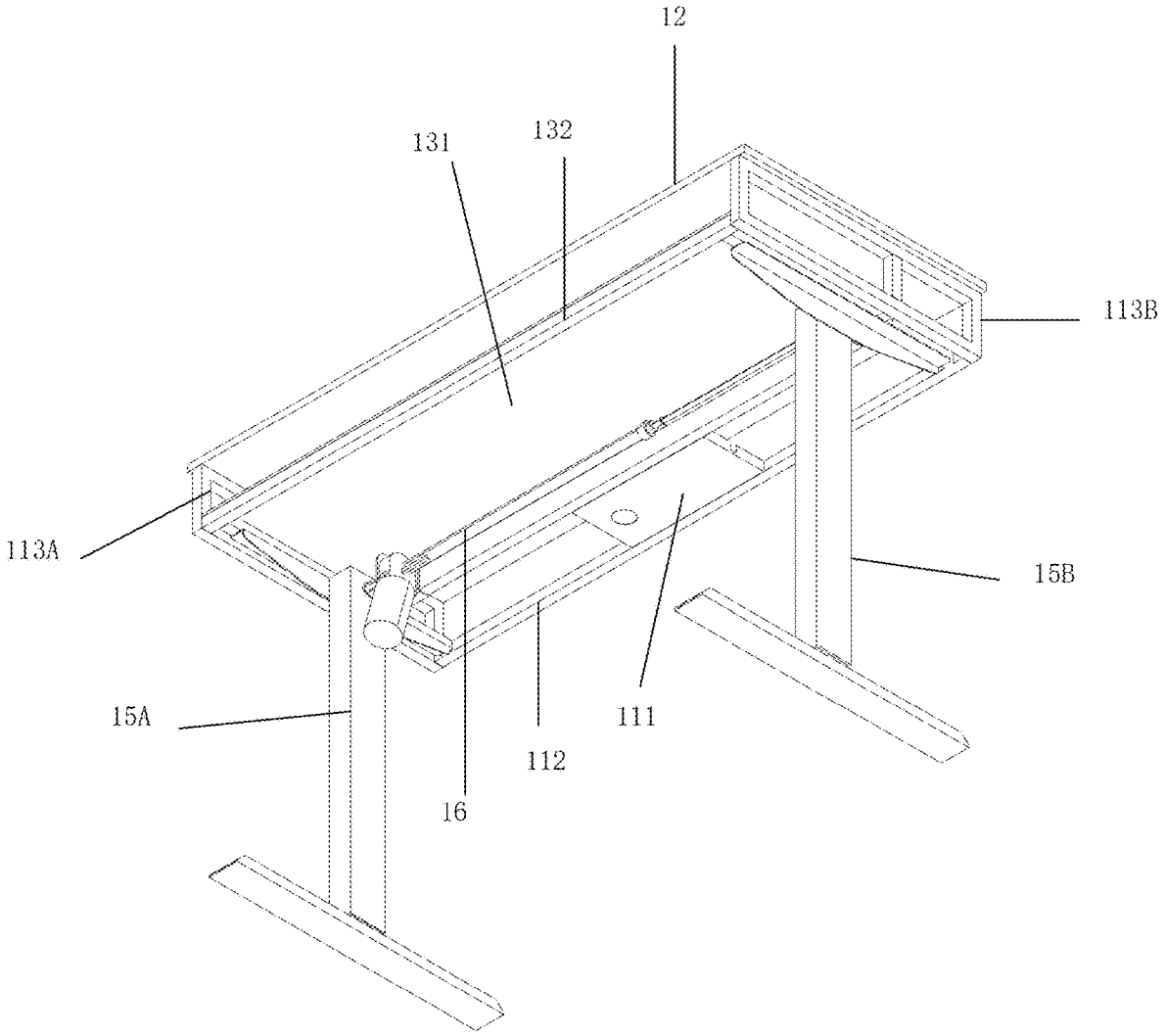
FIG. 3 shows a schematic structural diagram of a bottom right perspective view of a table with concealed cable management according to one embodiment of the present disclosure.
Figure 4:
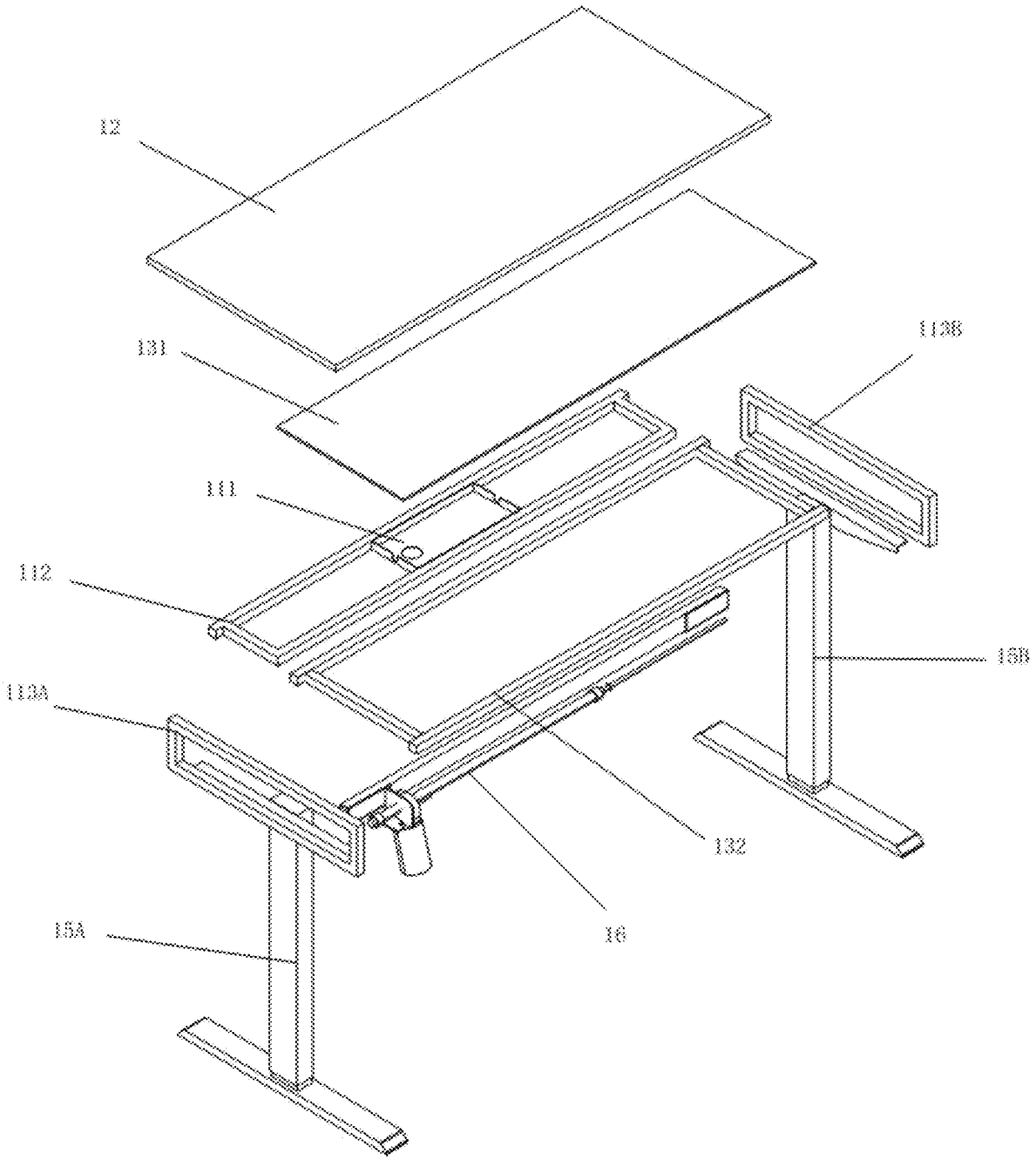
FIG. 4 shows a schematic explode diagram of a table with concealed cable management according to one embodiment of the present disclosure.

FIG. 1 shows a schematic structural diagram of a bottom left perspective view of a table with concealed cable management according to one embodiment of the present disclosure. FIG. 2 shows a schematic structural view of a bottom view of a table with concealed cable management according to one embodiment of the present disclosure. FIG. 3 shows a schematic structural diagram of a bottom right perspective view of a table with concealed cable management according to one embodiment of the present disclosure. FIG. 4 shows a schematic exploded diagram of a table with concealed cable management according to one embodiment of the present disclosure.

As shown in FIGS. 1 to 4, in one embodiment, the table includes two layers of table boards (a first table board 12 and a second table board 13). The first table board 12 is the face panel of the table, and the first table board 12 is connected to table side frames 14, which include a first table side frame 14A and a second table side frame 14B, for fixing the first table board 12. The second table board 13 is the laminated board of the table, the second table board 13 includes a shelf board 131 and a shelf connector frame 132. The shelf board 131 is connected to the shelf connector frame 132, and the shelf connector frame 132 is used to support the shelf board 131. The shelf connector frame 132 is connected to the table side frames 14, and is configured to fix the second table board 13. The size of the second table board 13 is smaller than that of the first table board 12. The table further includes table legs 15, which include a first table leg 15A and a second table leg 15B. The first table leg 15A is connected to the second table leg 15B by a connecting rod 16. The table side frames 14 are respectively connected on two sides of the table legs 15. Specifically, the first table side frame 14A is fixedly connected with the first table leg 15A, and the second table side frame 14B is fixedly connected with the second table leg 15B. This setup ensures that the table is securely fixed. All the panels can be connected either by screws or by welding.

In one embodiment, the fixing frames 113 including a first fixing frame 113A and a second fixing frame 113B of the cable management component 11 are the table side frames 14. The support frame 112 in the cable management component 11 is connected to the first fixing frame 113A and the second fixing frame 113B, so that the cable management component 11 is arranged below the first table board 12 of the table 1. At the same time, the second table board 13 of the table 1 is located on the outside of the cable management component 11, so that the second table board 13 can be used to expand storage space, and the cable management component 11 for supporting power supply equipment can be concealed under the table without affecting the overall attractiveness of the table.

Figure 5:
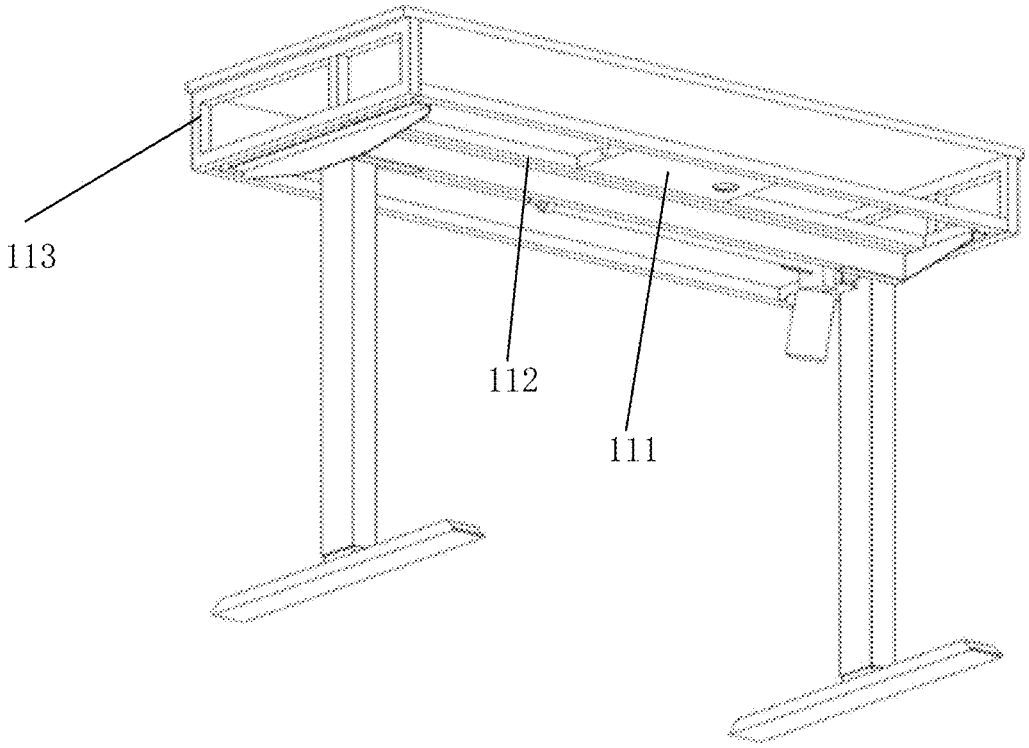
FIG. 5 shows a schematic diagram of a connection of a cable management component and table side frames according to one embodiment of the present disclosure.

FIG. 5 shows a schematic diagram of a table where the fixing frames 113 of the cable management component 11 serve as the table side frames 14 according to one embodiment of the present disclosure. As shown in FIG. 5, the fixing frames 113 including the first fixing frame 113A and the second fixing frame 113B are the table side frames 14. The support frame 112 of the cable management component 11 is connected to both the first fixing frame 113A and the second fixing frame 113B, so that the cable management component 11 is disposed below the second table board 13 and located on an inner side of the second table board 13 of the table 1. In one embodiment of the present disclosure, the fixing frames 113 are disposed below the table 1, and the support frame 112 is connected to the fixing frames 113, so that the cable management component 11 is set below the table 1 through the fixing frames 113.

In one embodiment, the table includes two layers of table boards (a first table board 12 and a second table board 13). The first table board 12 is the face panel of the table, which is located at the top of the table, and the first table board 12 is connected to the table side frames 14 (the first table side frame 14A and the second table side frame 14B) for fixing the first table board 12. The second table board 13 is the laminated board of the table, which is located below the first table board 12. The second table board 13 includes a shelf board 131 and a shelf connector frame 132 connected to the shelf board 131. The shelf connector frame 132 is used to support the shelf board 131. The shelf connector frame 132 is connected to the table side frames 14 and is configured to fix the second table board 13. The size of the second table board 13 is the same as or very close to that of the first table board 12. The table further includes table legs 15 (the first table leg 15A and the second table leg 15B). The first table leg 15A is connected to the second table leg 15B by a connecting rod 16. The table side frames 14 are respectively connected to two sides of the table legs 15. Specifically, the first table side frame 14A is fixedly connected with the first table leg 15A, and the second table side frame 14B is fixedly connected with the second table leg 15B. This setup ensures that the table is securely fixed. All the panels can be connected either by screws or by welding.

In one embodiment, the fixing frames 113 (the first fixing frame 113A and the second fixing frame 113B) of the cable management component 11 may be separate frames located underneath the first table board 12 of the table 1. The support frame 112 of the cable management component 11 is connected to both the first fixing frame 113A and the second fixing frame 113B, so that the cable management component 11 is disposed below the first table board 12 and located on an inner side of the second table board 13 of the table 1.

Figure 6:
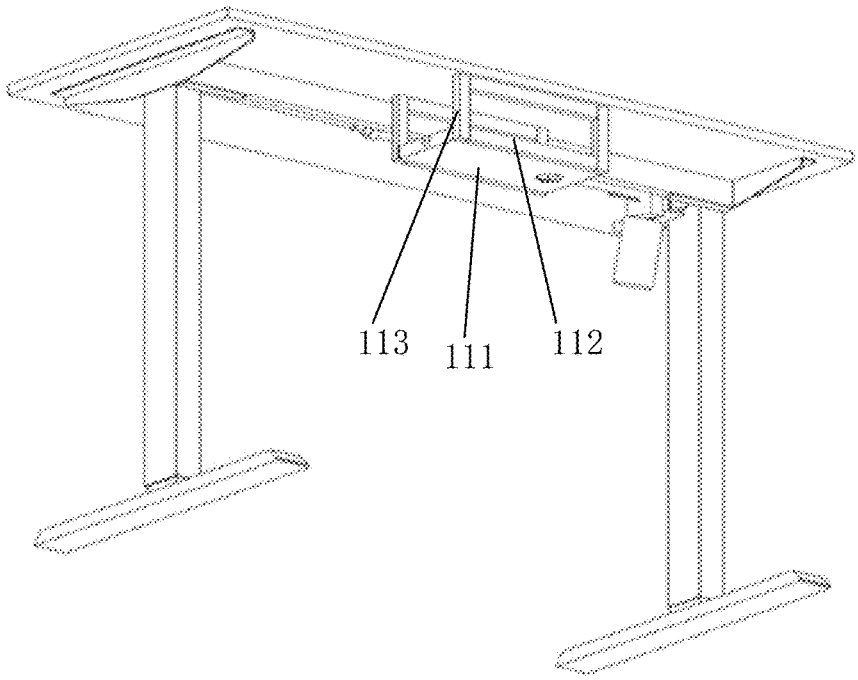
FIG. 6 shows a schematic diagram of a cable management component independently disposed below a table according to one embodiment of the present disclosure.

FIG. 6 shows a schematic diagram of the fixing frames 113 of the cable management component 11 as separate frames according to one embodiment of the present disclosure. As shown in FIG. 6, the first fixing frame 113A and the second fixing frame 113B of the cable management component 11 are separate frames located below the first table board 12 of the table 1. The support frame 112 of the cable management component 11 is connected to both the first fixing frame 113A and the second fixing frame 113B, so that the cable management component 11 is disposed below the first table board 12 and located on an inner side of the second table board 13 of the table 1.

In one embodiment, the fixing frames 113 (the first fixing frame 113A and the second fixing frame 113B) of the cable management component 11 are table side frames 14. The support frame 112 of the cable management component 11 is connected to both the first fixing frame 113A and the second fixing frame 113B, so that the cable management component 11 is disposed below the second table board 13 of the table 1.

In one embodiment, the fixing frames 113 (the first fixing frame 113A and the second fixing frame 113B) of the cable management component 11 are separate frames located below the second table board 13 of the table 1. The support frame 112 of the cable management component 11 is connected to both the first fixing frame 113A and the second fixing frame 113B, so that the cable management component 11 is disposed below the second table board 13 of the table 1.

It should be noted that, for the arrangement of the position, quantity and shape of the cable management component 11, this application is not limited thereto, and the user may set according to actual requirements.

In one embodiment of the present disclosure, the cable management shelf 111 is disposed on the support frame 112 through a screw.

In one embodiment of the present disclosure, the support frame 112 is provided with multiple fixing holes, and the cable management shelf 111 is connected to different fixing holes of the support frame 112 through screws to realize adjustable position.

In one embodiment, the support frame 112 is provided with three groups of fixing holes. The first group of the fixing holes is located at the left side of the support frame 112, and when the cable management shelf 111 is connected to the first group of fixing holes of the support frame through screws, it indicates that the cable management shelf 111 is located at the left position of the support frame.

The second group of fixing holes is located in the middle of the support frame 112, and when the cable management shelf 111 is connected to the second group of fixing holes of the support frame through screws, it indicates that the cable management shelf 111 is located in the middle of the support frame.

The third group of fixing holes is located at the right side of the support frame 112, and when the cable management shelf 111 is fixed to the third group of fixing holes of the support frame through screws, it indicates that the cable management shelf 111 is located at the right side of the support frame.

The first group of fixing holes, the second group of fixing holes and the third group of fixing holes are all threaded holes corresponding to the screws. The cable management shelf 111 is connected to the support frame 112 through adjustable screws, and the screws enter or exit the threaded holes in the support frame 112 by rotating, thereby adjusting the position of the cable management shelf 111 on the support frame 112. This method is easy to use, and suitable for a variety of storage and placement needs that require adjustable positioning.

It should be noted that the fixing holes set on the support frame 112 in the embodiments of this application are not limited to the first group of fixing holes, the second group of fixing holes, and the third group of fixing holes mentioned above, and the user may set according to actual needs, which is not specifically limited herein.

In one embodiment of the present disclosure, the cable management shelf 111 is disposed at any position of the support frame 112 by welding.

In one embodiment, the cable management shelf 111 can also be welded at any position of the support frame 112. This method uses welding technology to ensure stability and durability between the cable management shelf 111 and the support frame 112. This method is suitable for application scenarios requiring long-term fixation.

In one embodiment of the present disclosure, the cable management shelf 111 is disposed on the support frame 112 through a sliding rail, so that the cable management shelf 111 is movable along a long axis of the support frame 112 within the sliding rail of the support frame 112.

In one embodiment, the cable management shelf 111 can also be disposed on the support frame 112 through a sliding rail, where the cable management shelf 111 is mounted on a movable slider and disposed within the slide rail of the support frame 112, so that the cable management shelf 111 can move freely along the long axis of the support frame 112 within the slide rail of the support frame 112. By means of the sliding rail installation method, the user can easily slide the cable management shelf 111 along the sliding rail to arbitrarily adjust the position within the support frame 112, which provides extremely high flexibility and convenience, and is suitable for frequently adjusting the use environment of the position.

Figure 7:
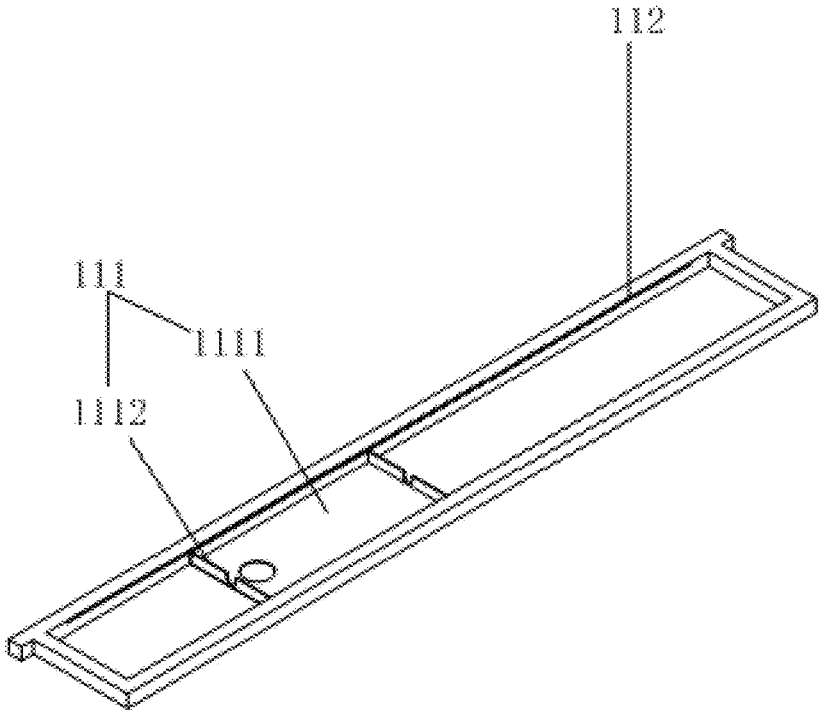
FIG. 7 shows a schematic structural diagram of a connection of a cable management shelf and a support frame according to one embodiment of the present disclosure.
Figure 8:
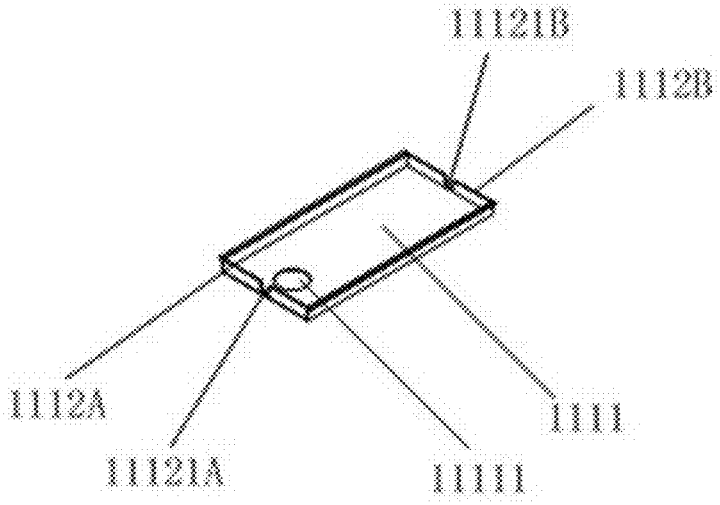
FIG. 8 shows a schematic structural diagram of a cable management shelf according to one embodiment of the present disclosure.

As shown in FIG. 7 and FIG. 8, in one embodiment of the present disclosure, the cable management shelf 111 includes a bottom surface 1111 and at least one side surface 1112. A first opening 11111 is provided on the bottom surface 1111 to allow power and/or device cables of the power supply device to pass through. Additionally, a second opening 11121 is provided on the side surface 1112 for the same purpose.

FIG. 7 shows a schematic structural diagram of a connection of the cable management shelf and the support frame according to one embodiment of the present disclosure. FIG. 8 shows a schematic structural diagram of the cable management shelf according to one embodiment of the present disclosure. As shown in FIG. 7 and FIG. 8, the cable management shelf 111 includes a bottom surface 1111 and side surfaces 1112. The side surfaces 1112 include a first side surface 1112A and a second side surface 1112B opposite to the first side surface 1112A and connected with the first side surface 1112A through the bottom surface 1111. The bottom surface is provided with a first opening 11111 to allow power and/or device cables of the power supply device to pass through. The first side surface 1112A and the second side surface B are both provided with a second opening 11121. Specifically, the first side surface 1112A is provided with a first side opening 11121A, and the second side surface 1112B is provided with a second side opening 11121B. Both the first side opening 11121A and the second side opening 11121B allow power and/or device cables of the power supply device to pass through.

Specifically, the cable management shelf 111 (the reference size is 30*13 cm, including but not limited to this size) can accommodate most power strips. The side surfaces of the cable management shelf 111 are respectively provided with an oval-shaped hole to facilitate winding and wiring, and a circular hole provided on the bottom surface of the cable management shelf 111 can better allow the power line and the device line to pass through, so that the power strip is more firmly fixed on the wire arrangement storage layer. By placing the power supply device on the cable management shelf 111, the user can optimize the disordered wiring of the table and the problem that the connection line of the desktop power supply device is too short. At the same time, under the support of the support frame 112, the cable management shelf 111 can easily accommodate external power strips or device cables while remaining concealed under the table, without affecting the overall appearance.

In one embodiment of the present disclosure, the cable management shelf 111 may be made of steel, plastic or wood. The support frame 112 may be made of pipes, plastic or wood.

In one embodiment of the present disclosure, the cable management component 11 is detachably disposed below the table 1.

Specifically, the cable management component 11 is detachably disposed below the table, and all the components of the table are detachably connected, that is, the overall structure of the table is detachable, thereby reducing the packaging volume and effectively utilizing the space below the table. At the same time, the installation method that combines the cable management component 11 with the frame structure of the table solves the problem of potential safety hazards caused by disordered wiring of existing power supply devices.

In one embodiment of the present disclosure, the cable management component 11 is fixedly disposed below the table 1.

Figure 9:
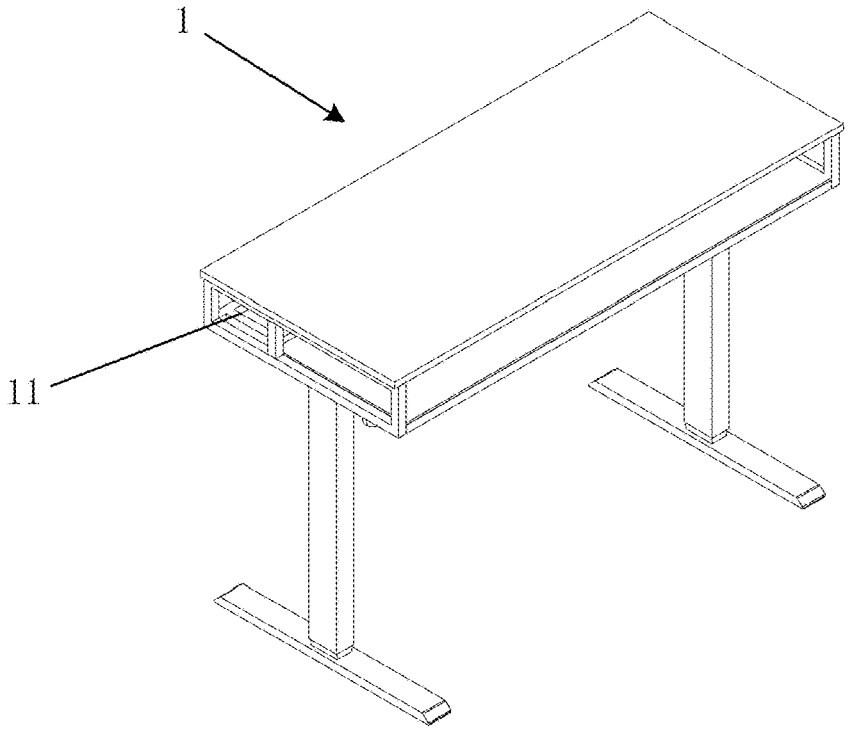
FIG. 9 shows a schematic structural view of a left perspective view of a table with concealed cable management according to one embodiment of the present disclosure.
Figure 10:
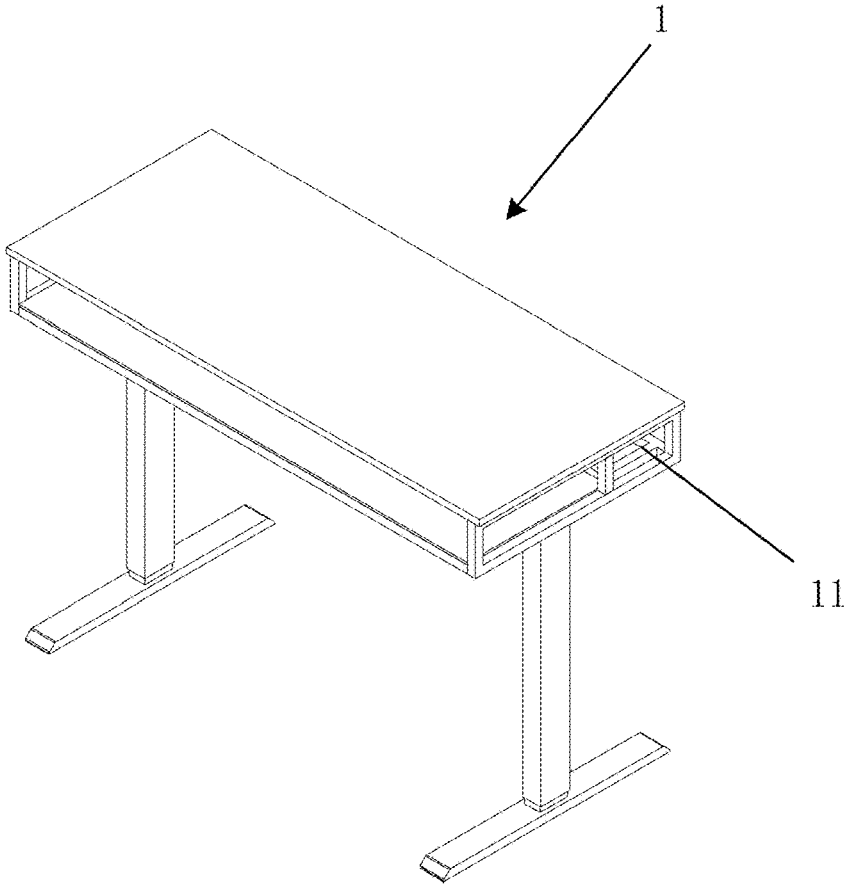
FIG. 10 shows a schematic structural view of a right perspective view of a table with concealed cable management according to one embodiment of the present disclosure.

FIG. 9 shows a schematic structural diagram of a left view of a table with concealed cable management according to one embodiment of the present disclosure. FIG. 10 shows a schematic structural diagram of a right view of a table with concealed cable management according to one embodiment of the present disclosure.

When the fixing frames 113 of the cable management component 11 serve as the table side frames 14, and the cable management component 11 is disposed below the first table board 12 and on the inner side of the second table board 13 (the table structure after installation is shown in FIGS. 9 and 10), the installation process of the table with concealed cable management according to one embodiment of the present disclosure is as follows:

Connecting the first table leg 15A and the second table leg 15B of the table 1 through a connecting rod 16, connecting the side frames 14 to both sides of the table legs 15 with screws, and mounting the first board 12 to the side frames 14 on both sides of the table legs 15 with screws; mounting the shelf board 131 of the second table board 13 to the shelf connector frame 132 with screws, and mounting the shelf connector frame 132 to the side frames 14 on both sides of the table legs 15 with screws, where the installation direction of the second table board 13 is close to the front face of the table.

In this embodiment, the fixing frames 113 (the first fixing frame 113A and the second fixing frame 113B) of the cable management component 11 are the table side frames 14, and after mounting the cable management shelf 111 of the cable management component 11 to the support frame 112 by screws, soldering, or a sliding rail, the support frame 112 is subsequently mounted to the table side frames 14 on both sides of the table legs 15 with screws. The cable management component 11 after installation is located under the first table board 12 and on the inner side of the second table board 13. In this way, the cable management component 11, which supports the power supply equipment, can be concealed beneath the table. This effectively utilizes the space below the table without affecting the overall aesthetic of the desk and solves the safety concerns associated with excessive and messy wiring of existing power supply equipment. At the same time, the second table board 13 can be used to expand the storage space, thereby making full use of the space underneath the table.

In summary, the table with concealed cable management described in the embodiments of the present disclosure has the following beneficial effects:

According to the table with concealed cable management of the present disclosure, the cable management component 11 is combined with the frame structure of the table 1, so that the cable management function is integrated into the structural design of the table, the space below the table is effectively utilized, and the problem of potential safety hazards caused by messy wiring of existing power supply equipment is solved. At the same time, the installation method that combines the cable management component 11 with the frame structure of the table 1 eliminates the need for an external cable management equipment such as a cable manager, making the table structure more integral and stable.

The cable management component 11 is detachably disposed below the table 1, and all the components of the table 1 are detachably connected, that is, the overall structure of the table 1 is detachable, thereby reducing the packaging volume and effectively utilizing the space below the table.

When the fixing frames 113 (the first fixing frame 113A and the second fixing frame 113B) of the cable management component 11 are the table side frames 14, the support frame 112 of the cable management component 11 is respectively connected to the first fixing frame 113A and the second fixing frame 113B, so that the cable management component 11 is disposed below the second table board 13 of the table 1, thereby ensuring the stability of the table and the bearing capacity of the cable arrangement shelf 111. Meanwhile, the storage capacity can be enhanced by connecting the cable management shelf 111, the support frame 112 and the table side frames 14 (the fixing frames 113). At the same time, under the support of the support frame 112, the cable management shelf 111 can easily accommodate external power strips or device cables while remaining concealed under the table, without affecting the overall appearance.

The cable management component 11 of the table with concealed cable management in the present disclosure is easier to install and less expensive compared to external cable management devices currently available in the market.

The descriptions of the processes or structures corresponding to the above figures each have their own emphasis. Parts that are not detailed in one process or structure can be referenced in the relevant descriptions of other processes or structures.

The embodiments described above serve merely as illustrative examples of the principles and effects of the present disclosure, and are not intended to serve as limitations on the invention. Persons skilled in the art may modify or alter these embodiments without departing from the spirit and scope of the present disclosure. Therefore, any equivalent modifications or alterations made by those skilled in the art, which are consistent with the spirit and technical concepts disclosed in the present disclosure, shall still fall within the scope of the claims of the present disclosure

The invention claimed is:

1. A table with concealed cable management, comprising a first table board, a second table board, and a cable management component, wherein the cable management component comprises a cable management shelf, a support frame, and fixing frames; wherein the second table board is below the first table board, and a size of the second table board is smaller than that of the first table board;

wherein the cable management shelf is connected to the support frame, so that the cable management shelf can support power supply equipment with the support of the support frame;

wherein the support frame is connected to the table boards by the fixing frames, and the cable management component is disposed below the first table board and located behind the second table board, side by side.

2. The table according to claim 1, wherein the fixing frames are disposed on two sides of table legs of the table, and the support frame is respectively connected to the fixing frames on the two sides of the table, so that the cable management component is disposed at the bottom of the table through the fixing frames.

3. The table according to claim 1, wherein the fixing frames are disposed below the first table board, and the support frame is connected to the fixing frames, so that the cable management component is disposed at the bottom of the table through the fixing frames.

4. The table according to claim 1, wherein the cable management shelf is disposed on the support frame through a screw.

5. The table according to claim 1, wherein the cable management shelf is arranged at any position of the support frame by welding.

6. The table according to claim 1, wherein the cable management shelf comprises a bottom surface and at least one side surface, wherein a first opening is provided on the bottom surface to allow power and/or device cables of the power supply device to pass through, and a second opening is provided on the side surface to allow power and/or device cables of the power supply device to pass through; wherein the first opening is a circular hole, and the second opening is an arced notch.

7. The table according to claim 6, wherein the bottom surface of the cable management shelf is rectangular.

8. The table according to claim 1, wherein the cable management shelf is made of steel, plastic or wood, and the support frame is made of pipes, plastic or wood.

9. The table according to claim 1, wherein the cable management component is detachably disposed at the bottom of the table.

10. The table according to claim 1, wherein the cable management component is fixedly disposed at the bottom of the table.

11. The table according to claim 1, wherein the fixing frames and the support frame are in shape of rectangular rings, the support frame is horizontally disposed, and the fixing frames are vertically disposed.

* * * * *